United States Patent [19]

Watanabe et al.

[11] 4,119,383

[45] Oct. 10, 1978

[54] METHOD AND APPARATUS FOR INSERTING INTERMEDIATE DOTS IN A DOT MATRIX USING A DOT PRINTER

[75] Inventors: Akinori Watanabe; Katsumasa Shinozuka, both of Tokyo, Japan

[73] Assignee: Oki Electric Industry Co., Ltd., Tokyo, Japan

[21] Appl. No.: 706,961

[22] Filed: Jul. 20, 1976

[51] Int. Cl.[2] ..... B41J 3/12; B41J 19/30

[52] U.S. Cl. ..... 400/124; 400/320

[58] Field of Search ..... 197/1 R; 101/93.05; 178/30; 340/324 AD

[56] References Cited

U.S. PATENT DOCUMENTS

| | | | |
|---|---|---|---|
| 3,703,949 | 11/1972 | Howard et al. | 197/1 R |
| 3,858,703 | 1/1975 | Duley | 197/1 R |
| 3,900,094 | 8/1975 | Larsen et al. | 197/1 R |
| 3,905,463 | 9/1975 | Boyle et al. | 197/1 R |
| 3,973,662 | 8/1976 | Fulton | 197/1 R |

*Primary Examiner*—Paul T. Sewell

*Attorney, Agent, or Firm*—Peter L. Berger

[57] ABSTRACT

A dot printer for printing characters and the like with a dot matrix which is capable of preventing irregular dot spacings by automatically compensating for the change of print timing resulting from a change in the speed of movement of the printing element.

17 Claims, 13 Drawing Figures

METHOD AND APPARATUS FOR INSERTING INTERMEDIATE DOTS IN A DOT MATRIX USING A DOT PRINTER

BACKGROUND OF THE INVENTION

The ever-increasing processing speed of the central processing unit in electronic computers is requiring output printing terminals of a higher speed capacity, and there have been proposed various systems for this purpose. The present invention relates to a dot printer for printing characters and the like with a dot matrix.

Such dot matrix printer is represented, for example, by a wire dot printer, a thermal printer and so on. In a wire dot printer, for example, the printing of dots is performed as shown in FIG. 1 by a print head 3 which is provided in front of a platen 1 and a paper sheet 2 and which presses an ink ribbon 6 against said paper sheet 2 while moving parallel thereto along the guide shafts 4, 5. As shown in FIG. 2, the above-mentioned print head 3 is provided, for example, with seven wires 7 arranged on a vertical line at the front end thereof and also is provided with seven magnets 8 at the rear end thereof for pushing said wires 7 to the printing position. The timing of dot printing, or, driving said wires 7 to said printing position, is determined by timing signals obtained by optically or magnetically detecting the slits 10 on a slit plate 9 mounted on said print head 3. FIG. 3 shows an example of slit detecting means in which the spacing between the slits 10 on said slit plate 9 corresponds to the spacing between the dot lines. Thus, a signal generated by a slit detecting element 12 incorporating a light receiving element 11 indicates that the print head 3 is advanced to a next dot printing position and activates the magnets 8 to advance the corresponding wires 7 to the printing surface.

Conventional wire dot printers have insufficient print quality due to a wider spacing of dots, as exemplified in FIG. 4 which shows the printing of character "E" and "A" by a 5 × 7 dot matrix.

For preventing such poor quality printing it has been proposed to print additional dots between dot lines. Such printing can be achieved for example by means of two wire lines which are mutually displaced by a half pitch and one of which is adapted to print the dots on the matrix while the other is adapted to print additional dots in positions displaced by a half pitch from aforementioned dots. Such method, however, requires a larger print head due to the presence of two wire lines and correspondingly a larger number of magnets for driving said wires. In order to prevent the above-mentioned drawbacks there is also known a dot printer with a single wire line for printing, wherein the dots on the matrix positions are printed by a timing signal generated for example by a slit plate and the additional intermediate dots are printed at a predetermined time after a timing signal, said predetermined time corresponding to one half of the period between two timing signals. Such printer, however, is still defective as the intermediate dots become not exactly positioned in the center between the dot lines on the matrix, thus deleteriously affecting the print quality, when the speed of movement of the print head has a fluctuation due to the characteristics of the spacing drive mechanism and the mass of said print head, since the timing of printing intermediate dots is fixed at a predetermined time after the timing signal.

SUMMARY OF THE INVENTION

In consideration of the above-mentioned drawbacks in the conventional printing systems, the present invention is to provide a printing method whereby the intermediate dots can be printed between the dot lines in the matrix.

OBJECTS

A first object of the present invention is to enable printing of intermediate dots in the middle of the dot lines in response to the spacing speed of the print head.

A second object of the present invention is to enable printing of intermediate dots in the middle of the dot lines in the matrix without providing printing elements in plural lines on the print head.

DETAILED DESCRIPTION OF THE INVENTION

Figure 1:
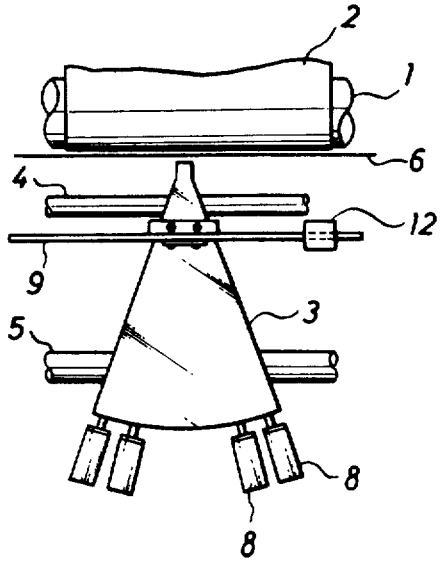
FIG. 1 is a plan view schematically showing a wire dot printer applicable to the present invention.
Figure 2:
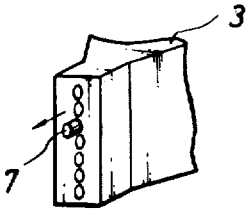
FIG. 2 is a perspective view showing the front end of a print head.
Figure 5:
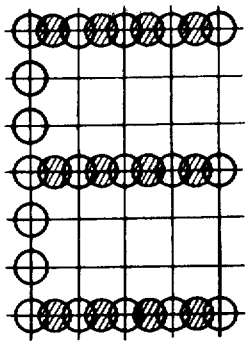
FIG. 5 is an example of character printing with a dot printer of the present invention.

Now referring to FIG. 5 which shows an example of a character printed by a wire dot printer according to the present invention, the character "E" is composed of dots ○ arranged in a matrix and intermediate dots ◐ printed in positions displaced from the lines of former dots by a half pitch. The structure of the printer for such printing is omitted here as it is structured in a same manner as explained in the foregoing with respect to FIG. 1. According to the present invention, said matrix dots ○ are printed in response to the timing slit signals obtained from a slit plate 9 in the conventional manner, while the intermediate dots ◐ are printed by the intermediate dot printing timing signals generated by a circuit shown in FIG. 6.

Figure 6:
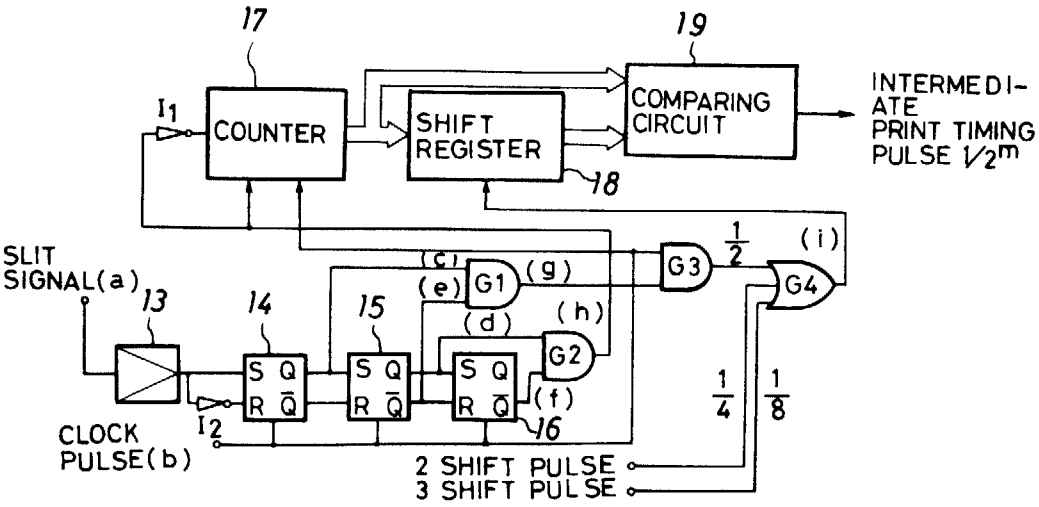
FIG. 6 is a block diagram showing a circuit for generating timing pulses for intermediate dot printing according to an embodiment of the present invention.

Now referring to FIG. 6, 13 is an amplifier for trimming the wave form of said slit signals and amplifying said signals to a determined voltage level, 14, 15 and 16 are flip-flops, 17 is a counter for counting t content pulses, 18 is a shift register for storing theof said counter 17 by successive shifts with shift pulses to be explained later, 19 is a comparing circuit for comparing the content of said counter 17 and that of said shift register 18 and releasing an output signal when said contents are equal or identical, G1, G2 and G3 are 'and' gates, G4 is an 'or' gate, and I1 and I2 are inverters; and the above-mentioned elements themselves are already known in the art.

Figure 3:
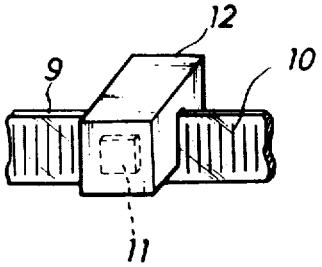
FIG. 3 is a perspective view showing a slit signal detecting means.
Figure 4:
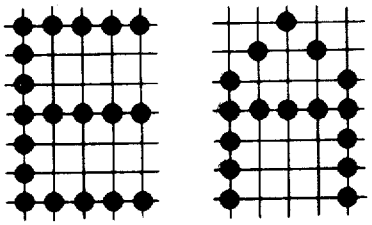
FIG. 4 is an example of character printing with a conventional dot printer.
Figure 7:
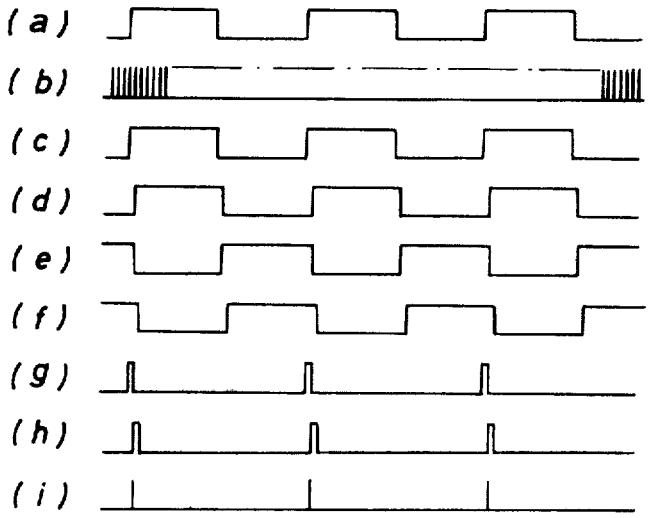
FIG. 7 is a diagram showing the wave form of signals in various parts in the circuit shown in FIG. 6.

Now in the following there will be given an explanation, with reference to the wave-form diagram shown in FIG. 7, on the function of the above-mentioned circuit for printing intermediate dots ⊖ displaced by a half pitch. At first, a slit signal shown in FIG. 7 (*a*) is obtained by a detecting element 12 (cf. FIG. 3) and applied through the amplifier 13 to the flip-flops 14, 15, 16 which then are sequentially shifted to 'set' positions upon each receipt of the clock pulse (*b*) from a clock pulse generator (not shown).

Figure 8:
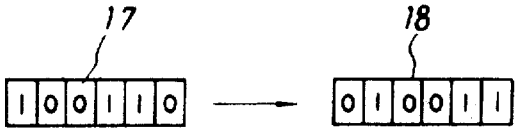
FIG. 8 is an explanatory drawing showing a part of function of the circuit shown in FIG. 6.

The 'and' gate G1 receives the 'set' output (*c*) of the flip-flop 14 and the 'reset' output (*e*) of the flip-flop 15, and generates a differental pulse (*g*) at the start of the slit signal (*a*). Said differential pulse (*g*) is applied, together with the clock pulse (*b*), to the 'and' gate G3, of which output is supplied, as shift pulse (*i*), through the 'or' gate G4 to the register 18. Upon receipt of said shift pulse (*i*), the register 18 stores the contents of said counter 17 with a shift by one bit. Thus, a count number stored in the counter 17, for example "100110" as shown in FIG. 8 is transferred to the register 18 with a shift by one bit as "010011", which corresponds to a half of said count number or a half of said count number minus one. Also the gate G2 generates, at the start of the 'set' output (*d*) from the flip-flop 15, a differential pulse which is supplied as a 'reset' pulse (*h*) to the counter 17. Upon receipt of said 'reset' pulse (*h*), the counter 17 returns to zero state. Said reset pulse is also supplied, through the inverter I1, as a count start signal to the counter 17 which thus starts to count the clock pulses supplied thereto. Now the function of the above-mentioned circuit is explained in a case of printing dots between the n-th dot line and $(n+1)$-th dot line. When a shift pulse is generated by a slit signal corresponding to the n-th dot line, the register 18 stores a number corresponding to a half of the count number (or minus one) counted by said counter 17 during a period from the slit signal of $(n-1)$-th dot line to the slit signal of n-th dot line. Thus the abovementioned number stored in the register 18 represents a period exactly one half from the slit signal of $(n-1)$-th dot line to the slit signal of n-th dot line, or a period required by the print head 3 to displace over a distance corresponding to a half of the pitch between the $(n-1)$-th dot line and the n-th dot line of the matrix, or eventually a period equal to the above-mentioned period minus a half clock cycle time. Consequently, when the counter 17 reaches, after resetting and renewed counting by the slit signal of n-th dot line, a count number equal to the number stored in the register 18, the print head 3 will be located at a position advanced from the n-th dot line by a half pitch or at a position slightly displaced from the above-mentioned position by a small distance toward the n-th dot line. Said small distance is the moving distance of the print head during a half clock cycle time (in the order of $10^{-9}$ sec) and thus is negligibly small compared with the distance of a half pitch.

Said comparing circuit 19 then identifies that the content of counter 17 is equal to that of the register 18, and releases an identify signal for actuating the wires 7, thus achieving dot printing between the n-th and $(n+1)$-th dot lines of the matrix.

Figure 9:
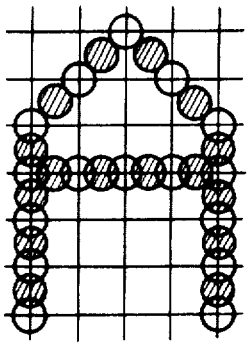
FIG. 9 is an another example of character printing obtained by a dot printer according to the present invention.

In this manner it is rendered possible to print dots in the positions displaced by a half pitch from the dot lines of the matrix. Moreover, by introducing a vertical motion in the print head 3 or in the paper 2 at the above-mentioned printing, it is made possible to print dots in diagonally intermediate positions with respect to the lines and rows of the matrix in case of characters with diagonal lines such as "A" shown in FIG. 9, and thus to further improve the quality of printing.

An eventual change in the displacing speed of the print head 3 gives rise to a corresponding change in the period between the slit signals. When the displacing speed is reduced, the period between the slit signals is elongated and the count by the counter 17 increases correspondingly, and vice versa.

Thus, according to the present invention wherein the half-pitch distance is detected by the count number, the period from the printing of matrix dots by a slit signal to the printing of intermediate dots displaced by a half pitch is made variable in response to the change of said spacing speed. In this manner, the intermediate dots are constantly positioned in the middle of the matrix dot lines and not deviated to the left or right irrespective of the spacing speed of the print head, thus assuring a constant print quality.

Furthermore, by supplying 2, 3, . . . , *m* shift pulses, instead of one shift pulse explained in the foregoing, to the 'or' gate G4, it is made possible to reduce the number to be stored in the register 18 to $\frac{1}{4}$, $\frac{1}{8}$, . . . , $\frac{1}{2^m}$, and thus to create the timing for intermediate dot printing at $\frac{1}{4}$, $\frac{1}{8}$, . . . , or $\frac{1}{2^m}$ of the distance between the matrix dot printing corresponding to the slit signals. In this manner it is rendered possible to perform dot printing in a desired position corresponding to the spacing speed of the print head.

Figure 10:
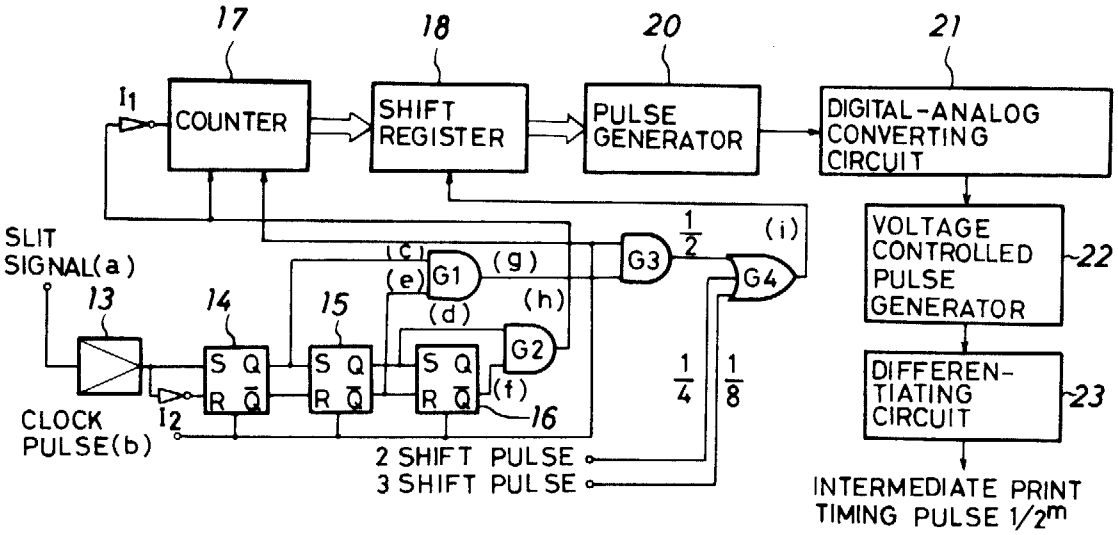
FIG. 10 is a block diagram showing an another embodiment of the present invention.

Another embodiment of the present invention is shown in FIG. 10, wherein the circuit from the amplifier 13 to the shift register 18 is constructed identical to that shown in FIG. 6. As to the remaining part of the drawing, 20 is a pulse generator for generating pulses of a determined number, 21 is a digital-analog converting circuit, 22 is a voltage controlled pulse generator for generating a pulse of a width corresponding to the input voltage, and 23 is a differentiating circuit.

At the printing of intermediate dots with the present embodiment, the function of the circuit up to the shift register 15 is identical to that of the circuit shown in FIG. 6.

In case of printing intermediate dots between the n-th and $(n+1)$-th dot lines in the matrix, upon receipt of a shift pulse resulting from a slit signal corresponding to the n-th dot line, the register 18 stores a number equal to a half of the count number (or minus one) counted by the counter 17 in a period from the slit signal for the $(n-1)$-th dot line to that for the n-th dot line. Said number stored in said register 18 represents a period one half of the period from the slit signal for the $(n-1)$-th dot line to that for the n-th dot line, namely a period necessary for the print head 3 to displace over a distance corresponding to a half of the pitch between the $(n-1)$-th and n-th dot line in the matrix, or a period equal to the above-mentioned period minus a half clock cycle time. Said number stored in the register 18 is given to the pulse generator 20, which generates pulses of a number corresponding to the number stored in the register 18. Said pulses are supplied to the digital-analog converting circuit 21 and converted therein to a voltage corresponding to the number of said pulses, and said voltage is supplied to the voltage-controlled pulse generator 22 and converted therein to a one-shot pulse of a pulse width corresponding to said generated voltage.

The termination of said one-shot pulse is detected by the differentiating circuit 23, which correspondingly produces a print timing pulse. In this manner, said print timing pulse is produced at different times depending upon the number stored in said register 18. As said number indicates a period corresponding to a half of the time between the $(n-1)$-th and n-th slit signals or a period equal to said period minus a half clock cycle time, said print timing pulse is always positioned in the middle of two slit signals or slightly ahead by said half clock cycle time. As explained in the foregoing embodiment shown in FIG. 6, said half clock cycle time is negligibly small with respect to one half of the period between two slit signals.

In this manner, it is rendered possible to print the intermediate dots in the positions displaced by a half pitch from the matrix dots.

Furthermore, as explained before with respect to FIG. 6, by supplying 2, 3, . . . , $m$ shift pulses to the 'or' gate G4, the number stored in the register 18 is correspondingly reduced to $\frac{1}{4}$, 150 , . . . , $\frac{1}{2}^m$, thus enabling the release of the intermediate print timing pulse at a desired timing corresponding to $\frac{1}{4}$, 150 , . . . , or $\frac{1}{2}^m$ of the spacing between the dot lines printed by the slit signals. Furthermore the release time of the intermediate print timing pulse can be modified by adjusting the voltage-controlled pulse generator 22.

Figure 12:
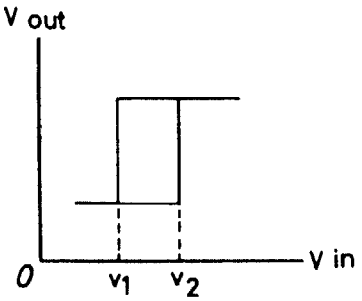
FIG. 12 and FIG. 13 are wave-form diagrams showing the characteristics of a Schmidt trigger circuit constituting the voltage-controlled pulse generator.
Figure 11:
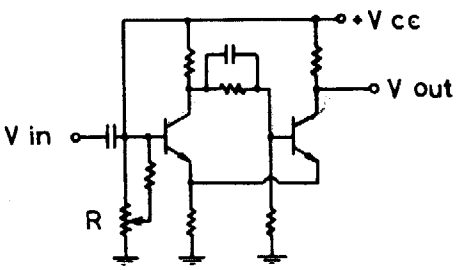
FIG. 11 is a circuit diagram of a voltage-controlled pulse generator.
Figure 13:
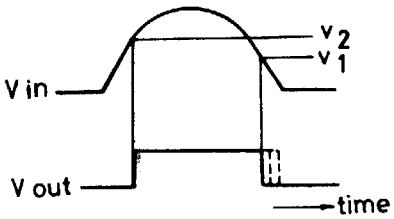

Said voltage-controlled pulse generator 22 is composed of a Schmidt trigger circuit shown in FIG. 11. As already known, said Schmidt trigger circuit shows a hysteresis in the output voltage $V_{out}$ with respect to the input voltage $V_{in}$ as shown in FIG. 12, and is capable of performing so-called voltage identifying function by producing an output square pulse of a pulse width corresponding to the value of input voltage $V_{in}$ as shown in FIG. 13. The end point of said square pulse can be varied by changing the variable resistor R in said circuit for the same input voltage. Thus, said variable resistor R enables fine adjustment of the timing of said intermediate print timing pulse, thus assuring dot printing in an arbitrary position at any displacing speed.

Although the foregoing explanation is related to a case where the print head is displaced to the right, a same function can be expected also in a displacement to the left, thus allowing printing in both directions.

Furthermore, although the foregoing explanation is solely directed to the application in wire dot printers, it will be understood that the method of the present invention is also applicable to the dot printers of other types such as a thermal printer in which the thermal elements are arranged in a same manner as in the above-mentioned wire dot printer, a discharge printer with the electrodes of a similar arrangement, an electrostatic printer and the like.

As explained in the foregoing description, the present invention is advantageous in that it is not necessary to use dot printing elements in plural lines on a print heat in a wire printer, a thermal printer or other dot printers and in that it is rendered possible to print the intermediate dots always exactly in the middle of the dot lines of matrix, thus assuring an elevated print quality.

What is claimed is:

1. A dot printer of the type having sequential dots printed in matrix form by generating print timing pulses as a print head is moved in relation to a paper upon which printing occurs, said sequential dots being identified as $n-1$th, $n$th and $n+1$th dots a plurality of pulse generation means associated with said print head to provide discrete pulses as said print head is moved, said dots being printed at a pitch corresponding to the distance between adjacent pulse generation means, the improvement comprising means to measure the time period between the printing of said $n-1$th dot and said n-th dot printed to form a first quantity, means to multiply said first quantity by $\frac{1}{2}^m$, where $m$ is an integer, to form an intermediate dot print signal occurring at a time equal to $\frac{1}{2}^m$ pitch between said $n-1$ and $n$-th dot pulses, said intermediate dot print signal applied to said print head to cause an intermediate dot to be printed at a time equal to said $\frac{1}{2}^m$ pitch time after said $n$th dot is printed so that said intermediate dot is printed at said $\frac{1}{2}^m$ pitch time after said $n$th and before said $n+1$th dot, whereby between two sequential dots, the first being called $n-1$ and the second $n$, a time quantity is determined which later controls printing of an intermediate dot between the next sequential dots, said next sequential dots being $n$ and the next $n+1$.

2. A dot printer as set forth in claim 1 comprising means for moving said print head vertically with respect to said paper to print said intermediate dots in a diagonal direction.

3. A dot printer as set forth in claim 1 comprising means connected to said means to multiply for adjusting the time occurrence at which said intermediate dot is printed between said nth and $n+1$th said next sequential dot.

4. A dot printer comprising a print head printing sequential dots at discrete locations on a printing paper, said sequential dots being identified as $n-1$th, $n$th and $n+1$th dots said print head being displaced relative to said printing paper with means for producing print timing pulses being connected to said print head, measuring means for measuring the time between the printing of said $n-1$-th and said $n$-th dot, to form a first quantity, said measuring means being connected to receive said print timing pulses, multiplying means to multiply said first quantity by $\frac{1}{2}^m$, where $m$ is an integer, to form a second quantity which is equal to an intermediate time period less than the time period between the occurrence of said $n-1$-th and $n$-th print timing pulses, and intermediate dot printing means connected to said multiplying means to cause a dot to be printed at said intermediate time period after the printing of said n-th dot and before said $n+1$-th dot, whereby between two sequential dots, the first being called $n-1$ and the second $n$, a time quantity is determined which later controls printing of an intermediate dot between the next sequential dots, said next sequential dots being $n$ and the next $n+1$.

5. A dot printer as set forth in claim 4 wherein said measuring means comprises a clock pulse and a counter, said counter commencing counting said clock pulses at the occurrence of said $n-1$-th print timing pulse, said counter counting the number of pulses produced as said print head is displaced between printing positions corresponding to said $n-1$-th and $n$-th dots.

6. A dot printer as set forth in claim 5, wherein said measuring means comprises a shift register, said $n$-th print timing pulse being coupled to said counter and said shift register to shift the count in said counter to said shift register at the occurrence of said $n$-th printing timing pulse, said shift register receiving a digital quantity equal to $\frac{1}{2}^m$ of the quantity in said counter, where $m$ equals the number of shift pulses generated when said $n$-th printing timing pulse occurs.

7. A dot printer as set forth in claim 6, comprising comparator means connected to said counter and said register to produce an intermediate print timing pulse when the contents of said shift register and counter are equal, said shift register holding a value equal to $\frac{1}{2}^m$ the time period between said $n-1$-th and $n$-th print timing pulse, said counter receiving clock pulses after said $n$-th printing timing pulse whereby said comparator produces an intermediate print timing pulse when said counter reaches the count held in said shift register.

8. A dot printer as set forth in claim 6, comprising a digital to analog converter connected to said shift register, said converter producing an analog signal representative of said intermediate time period, a voltage-controlled pulse generator for generating said intermediate print timing pulse at a time corresponding to the amplitude of said analog signal.

9. A dot printer as set forth in claim 8, wherein said voltage controlled pulse generator comprises means to shift the time of occurrence of said intermediate print timing pulse.

10. A dot printer as set forth in claim 4, comprising means to move said print head vertically with respect to said printing paper to effect intermediate dot printing in a diagonal direction.

11. For a dot printer printing characters with a dot matrix by having a print head moving across a surface upon which dots are selectively deposited, a method for printing an additional dot between pairs of sequential dots in the matrix said sequential dots being identified as $n-1$th, $n$th and $n+1$th dots comprising measuring the time it takes said print head to move from a first matrix position where said "$n-1$th" dot is deposited to the next matrix position where said "$n$th" dot is deposited, forming a first quantity representing said time, dividing said time to form a second quantity which is a fraction of said first quantity, and depositing an intermediate dot on said surface at the time represented by said second quantity after the deposition of said "$n$th" dot, said intermediate dot being located between said "$n$th" dot and the next sequential dot represented by the "$n+1$th" dot whereby between two sequential dots, the first being called $n-1$ and the second $n$, a time quantity is determined which later controls printing of an intermediate dot between the next sequential dots, said next sequential dots being $n$ and the next $n+1$.

12. The method of claim 11 further comprising forming a first digital representation of said first quantity and multiplying said first quantity by $\frac{1}{2}^m$ where $m$ is an integer, to form said second quantity.

13. The method of claim 6 further comprising vertically moving said print head with respect to said surface to print said intermediate dots in a diagonal direction.

14. A method as set forth in claim 11 further comprising adjusting the timing of the production of said intermediate dot between said $n$ and $n+1$-th dot.

15. For a dot printer printing characters with a dot matrix by having a print head moving across a surface upon which dots are selectively deposited, an improvement comprising means for printing an additional dot between pairs of sequential dots in the matrix said sequential dots being identified as $n-1$th, $n$th and $n+1$th dots comprising measuring means to determine the time it takes said print head to move from a first matrix position where an "$n-1$th" dot is deposited to the next matrix position where an "$n$th" dot is deposited, first quantity means to form a first quantity representing said time said first quantity means connected to said measuring means to determine dividing means connected to said first quantity to divide said time to form a second quantity which is a fraction of said first quantity, and means to actuate said print head to deposit an intermediate dot on said surface at the time represented by said second quantity after the deposition of said "$n$th" dot, said intermediate dot being located between said "$n$th" dot and the next sequential dot represented by the "$n+1$th" dot whereby between two sequential dots, the first being called $n-1$ and the second $n$, a time quantity is determined which later controls printing of an intermediate dot between the next sequential dots, said next sequential dots being $n$ and the next $n+1$.

16. The improvement of claim 15, wherein said dividing means comprises means to divide said first quantity approximately in half to form said second quantity.

17. The improvement as set forth in claim 15 comprising means for moving said print head vertically with respect to said surface to print said intermediate dots in a diagonal direction.

* * * * *